United States Patent [19]

Watts

[11] 4,242,013

[45] Dec. 30, 1980

[54] METHOD FOR FORMING A HOLE IN THE EARTH

[76] Inventor: James P. Watts, 6930 Pinchot Ave., Scottsdale, Ariz. 85251

[21] Appl. No.: 45,248

[22] Filed: Jun. 4, 1979

[51] Int. Cl.[3] ..... E02D 17/04; E02D 29/02

[52] U.S. Cl. ..... 405/272; 405/287; 175/62

[58] Field of Search ..... 405/272, 284–287, 405/11; 175/62

[56] References Cited

U.S. PATENT DOCUMENTS

| | | | |
|---|---|---|---|
| 363,419 | 5/1887 | Poetsch | 405/11 |
| 3,710,579 | 1/1973 | Killmer | 405/11 |

FOREIGN PATENT DOCUMENTS

| | | | |
|---|---|---|---|
| 912320 | 8/1946 | France | 405/285 |
| 1044620 | 11/1953 | France | 405/11 |
| 1180653 | 2/1970 | United Kingdom | 405/272 |

*Primary Examiner*—Stephen J. Novosad

*Attorney, Agent, or Firm*—Drummond and Nelson

[57] ABSTRACT

In forming holes in the earth, a circular frame of columns supported by structural members is placed in the earth to provide lateral support for the side walls of the hole while the hole is being excavated and after the hole is excavated. The structural members are generally concentric with the circle formed by the columns and, in reaction to the compressive forces of the earth acting on the columns, compressed between at least two columns. The method is specially adapted for use in forming holes in loose soils.

3 Claims, 15 Drawing Figures

METHOD FOR FORMING A HOLE IN THE EARTH

This invention relates to an improved method for forming a hole in the earth.

In another respect, the invention relates to a method for forming a hole, in particular for forming a hole of substantial size in the earth in which special means are provided to prevent the side walls of the hole from collapsing inwardly during and after excavation of the hole.

In a further respect, the invention relates to an improved method for forming a hole in the earth and for preventing the side walls of the hole from collapsing inwardly, which method may be used in all types of soils including loose soils, such as sandy or wet soils.

The necessity for excavating holes of substantial size has existed in a variety of construction contexts. For example, in the construction of high rise buildings, sizeable holes are normally required for foundation piers. Similarly, large foundation piers are often needed in bridge construction. Large excavations have also been made as an integral part of attempts to stabilize ground movement. In this regard, sizeable holes have been dug and filled with concrete or other materials so that the ground in a given area will not collapse or slide during earthquakes or during periods of greater than normal rainfall.

Another instance in which substantial excavation is required is in the construction of buildings which are partially or completely underground. The current emphasis on the design of energy-efficient buildings has apparently increased interest in subterranean construction.

In the past, the excavation of large holes in the earth has presented two serious problems. First, the sides of the hole have tended to collapse before the excavation was completed, especially if the hole was being formed in loose soil. Secondly, because of the tendency of the sides to collapse in part or in whole, excavation of large holes inherently involved a high degree of danger. Construction worker fatalities have been the norm rather than the exception.

In an attempt to minimize these problems, prior art techniques were developed which placed a structure in the earth to define a sleeve-like support perimeter around the area where the hole was to be excavated. The prior art techniques are, for a number of reasons, generally unsatisfactory. for instance, some of the prior art techniques utilize a rectangular support structure. Such a structure is generally more costly to use because it is inherently weak at the midpoints of its walls. As a result the walls forming the rectangular sleeve must be made proportionately stronger to compensate for the weakness at their midpoints or must be braced. Braces for the walls typically are attached to the bottom of or span the hole itself. If it was intended to build a structure in the hole proper, such bracing systems would be inconvenient to work around.

Other prior art techniques have prohibitive cost and installation time requirements. For example, according to one prior art technique, hollow piles, after being driven into the ground and having the earth removed from within the piles, are filled with concrete. Means are provided for interconnecting the piles to form a sleeve-like support structure. This prior art technique becomes prohibitively time-consuming and expensive when pilings have to be driven into the ground around an excavation site of substantial breadth and depth. Also, it is difficult to use this technique in generally rocky ground.

Accordingly, it is the principal object of the present invention to provide an improved method for forming a hole in the earth.

Another object of the invention is to provide an improved method for forming a hole in the earth which combines structural simplicity with optimum structural efficiency in resisting compressive forces on the side of the hole.

Yet another object of the invention is to provide an improved method for forming a hole in the earth which functions in all types of soils, including loose soils, such as sandy or wet soils.

Still another object of the invention is to provide a method for forming a hole in the earth which is inherently safe in application and will minimize the construction worker fatality rate associated with the formation of sizeable holes in the earth.

A yet further object of the invention is to provide an improved method for forming a hole in the earth which is generally less expensive and less time-consuming in application than prior art methods.

These and other, further and more specific objects and advantages of the invention will be apparent to those skilled in the art from the following detailed description thereof, taken in conjunction with the drawings, in which.

Briefly in accordance with my invention, I provide a method for forming holes in the earth. The method of the invention is an improvement over the prior art method which includes the steps of driving hollow piles into the earth, removing the earth forced into the piles while the piles were being driven out, and filling the piles with concrete. The improvements which are provided in accordance with the invention comprise the steps of placing an essentially circular frame of individual columns in the earth, supporting the frame with structural members to resist inward compressive forces of the surrounding earth and excavating earth from within he perimeter of the frame to form the hole. The structural members resisting inward compressive forces of the surrounding earth are generally concentric with the circle generally formed by the columns, and, in reaction to the inward compressive forces, are compressed between at least two columns.

According to one presently preferred embodiment of the invention, the improved method of forming a hole in the earth includes the steps of drilling individual column holes in an essentially circular arrangement, filling the column holes with concrete to the desired level so that columns are formed, excavating earth from the area within the perimeter formed by the columns to a point just below the level where a compression ring is to be attached to the interior surface of each of the columns, installing the compression ring, and repeating the step of excavating earth to a point just beneath the installation level of the compression ring and of installing the compression ring to install a plurality of spaced compression rings along the interior surface of the columns.

According to an alternate preferred embodiment of the invention, the improved method of forming a hole in the earth includes the steps of determining where a plurality of individual column holes in an essentially circular arrangement will be drilled, where the column holes are identifiable as and divided into a first group and a second group, such that each of the column holes in the first group is adjacent to at least one of the columns in the second group, drilling the column holes in the first group, drilling a plurality of lateral holes along the length of and extending from the walls of the column holes in the first group and intersecting the location where the column holes in the second group are to be drilled, filling the column holes of the first group and the lateral holes with concrete to the desired level so that columns and lateral supports are formed, drilling the column holes in the second group, filling the column holes in the second group with concrete to the desired level so that columns are formed, and excavating earth from within the perimeter formed by the columns.

Figure 1:
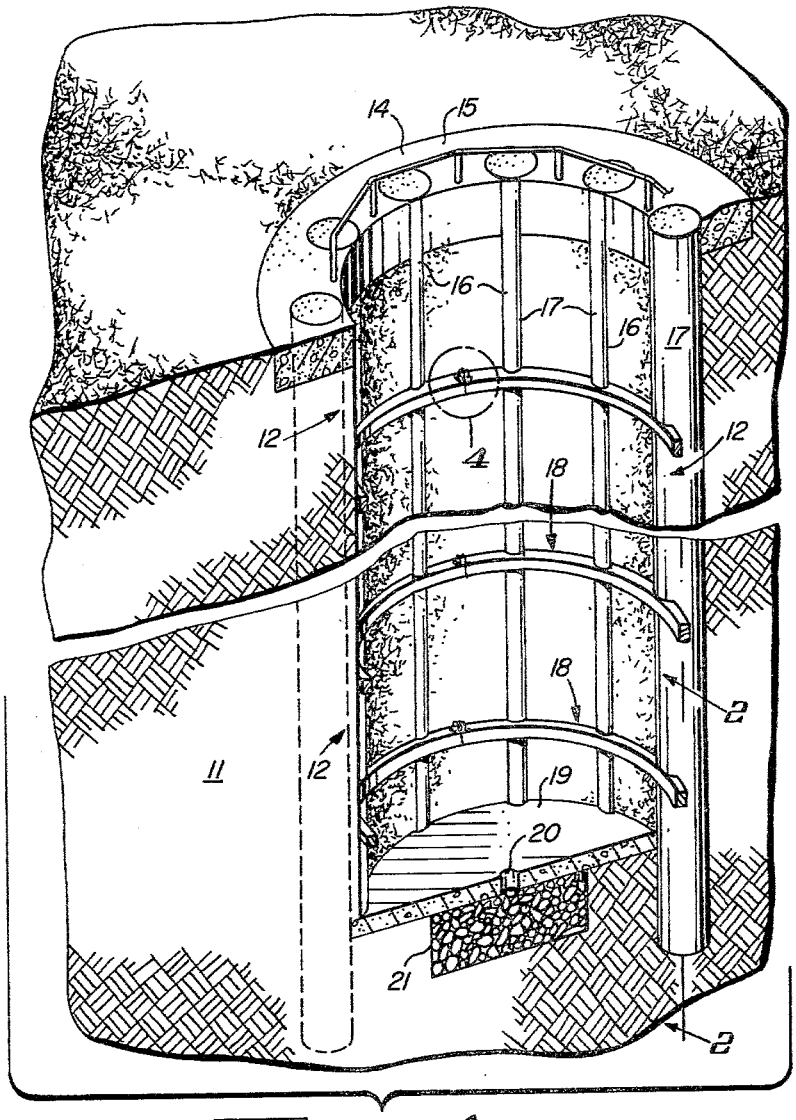
FIG. 1 is a perspective, partially cut-away view of a hole in the earth formed with columns and compression rings in accordance with one presently preferred embodiment of the invention.

Turning now to the drawings, which depict the presently preferred embodiments of the invention for the purpose of illustrating the practice thereof and not by way of limitation of the scope of the invention, FIG. 1 illustrates a hole 12 formed in the earth 11 in accordance with the first presently preferred embodiment of the invention. An optional collar 14 with safety railing 15 has been provided, column holes 16 drilled, concrete columns 17 formed and compression rings 18 attached to the columns 17. An optional floor 19 with a drain 20 has been installed. A fluid-dissipating rock-filled sump 21 is provided beneath the drain 20.

Figure 2:
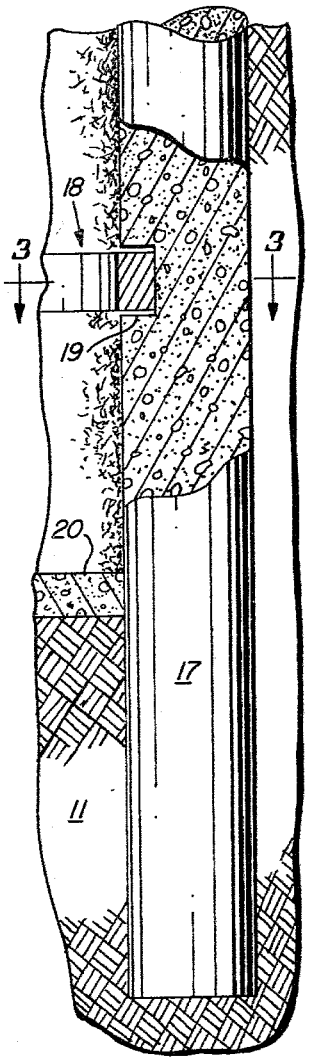
FIG. 2 is a cross-sectional partially cut-away view of a column of FIG. 1 taken along section line 2—2.
Figure 3:
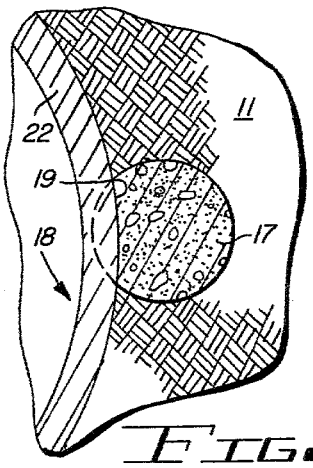
FIG. 3 is a cross-sectional view of the junction of the compression ring and column of FIG. 2 taken along section line 3—3.

The compression rings 18 are, as shown in FIGS. 2 and 3, inserted in notches 19 cut in the columns 17.

Figure 4:
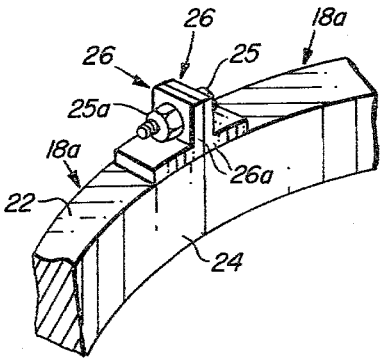
FIG. 4 is an enlarged perspective view of the means of connecting two segments of the compression ring of FIG. 1.
Figure 5:
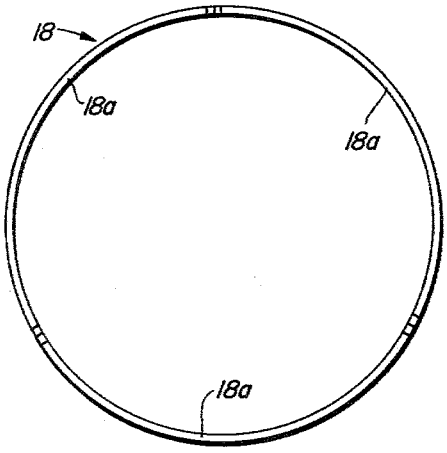
FIG. 5 is a top view of an assembled compression ring.

As illustrated in FIGS. 4 and 5, the compression rings 18 are formed of three equi-length curved segments 18*a*. Each segment 18*a* is provided with an L-shaped bracket 26 attached to the upper surface 22 of the segment 18*a* with he upwardly projecting leg 26*a* of the bracket 26 being flush with the end 24 of the segment 18*a*. Each segment 18*a* has a bracket 26 at each end of the segment 18*a*. The ends 24 of the segments 18*a* are secured in an abutting position by screwing the internally threaded nut 25*a* onto the externally threaded insert 25 mounted in the brackets 26.

FIGS. 6A–6D schematically illustrate the steps involved in forming a hole in the earth according to the first presently preferred embodiment of the improved method of the present invention.

Figure 6A:
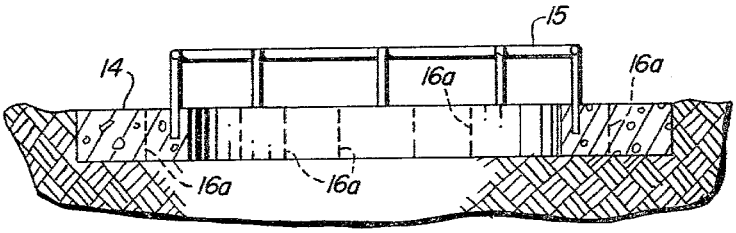
FIGS. 6A–6D are schematic sectional views showing the steps of forming a hole in the earth in accordance with one presently preferred embodiment of the invention.

The optional first step of the method is illustrated in FIG. 6A, which shows a concrete collar 14 with apertures 16*a* to allow drilling the column holes 16 therethrough. A safety rail 15 is optionally installed on the collar 14.

Figure 6B:
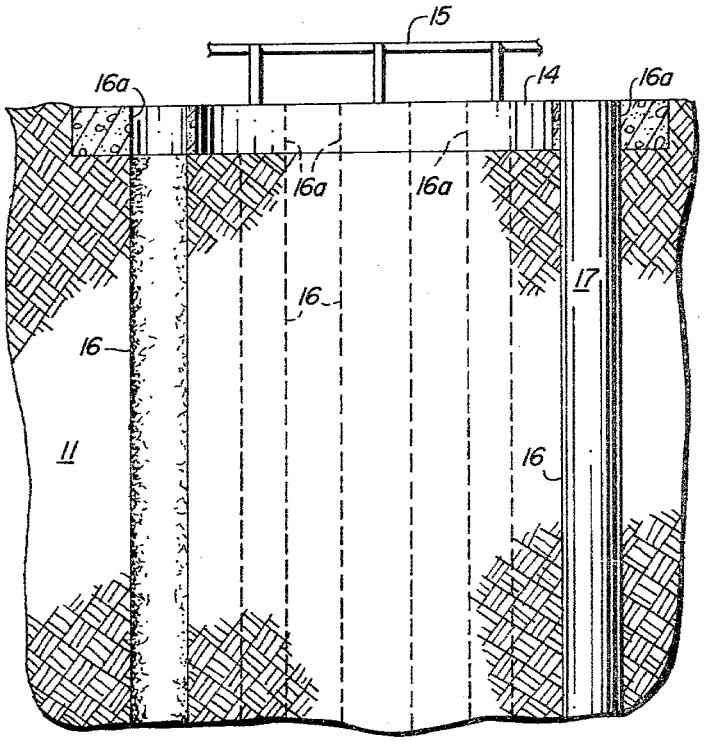

The next steps in the method are shown in FIG. 6B, which illustrates the drilled column holes 16 and one of the column holes 16 and its companion aperture 16*a* having been filled with concrete to form a column 17.

Figure 6C:
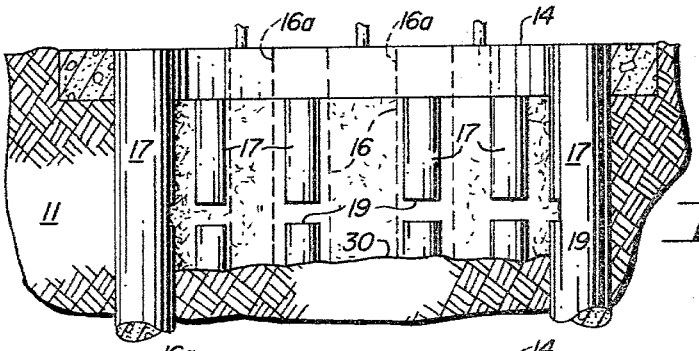
Figure 6D:
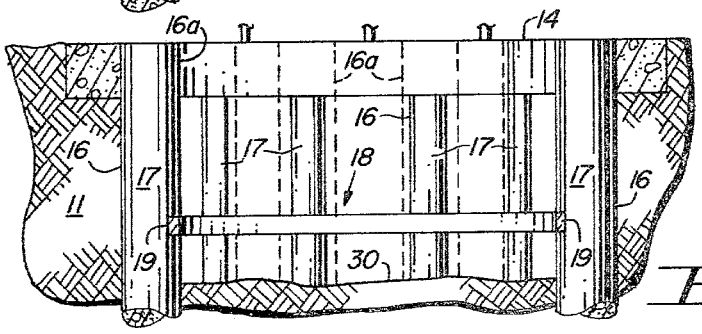

As shown in FIGS. 6C and 6D, after all of the holes 16 and their companion collar apertures 16*a* have been filled with concrete to form columns 17, the earth 11 within the perimeter formed by the columns 17 is excavated to a level 30 just below the position where the first compression ring 18 is to be installed. Then the columns 17 are notched 19 and the compression ring 18 is installed. The earth 11 is then excavated to a level just below the point where the next compression ring 18 is to be installed and the columns 17 are notched 19 and the compression ring 18 installed. This process is repeated until all of the compression rings 18 are installed spaced along the columns 17.

FIGS 7A–7D illustrate the steps involved in forming a hole in the earth according to an alternate preferred embodiment of the improved method of the present invention.

Figure 7A:
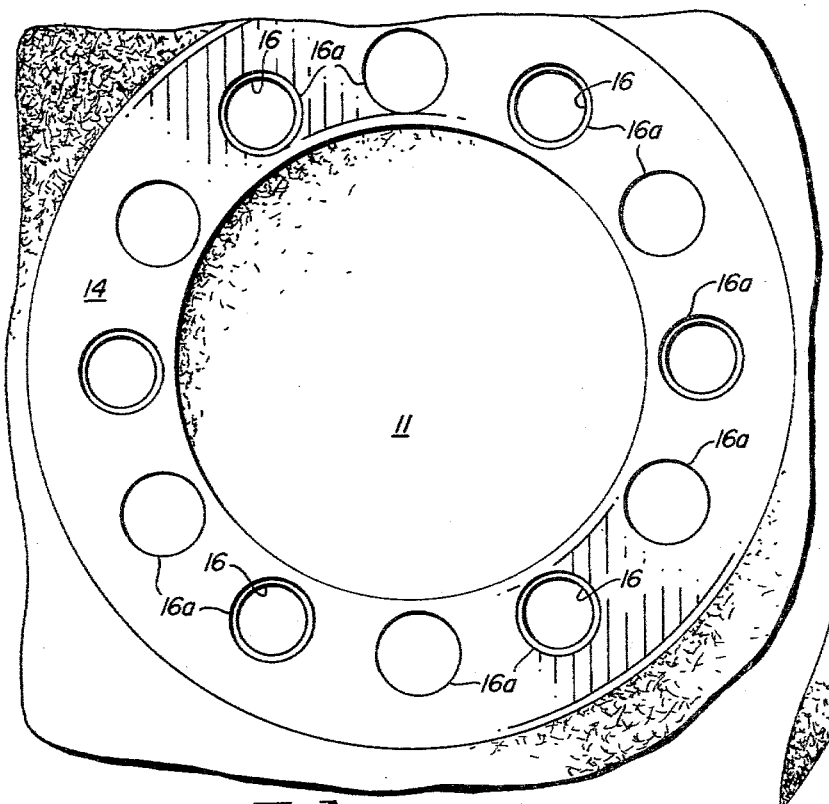
FIGS 7A–7D are schematic top views illustrating the steps of forming a hole in the earth with columns and lateral supports between the columns in accordance with an alternate preferred embodiment of the invention.

In FIG. 7A, an optional collar 14 with apertures 16*a* for drilling column holes 16 has been formed.

Figure 7B:
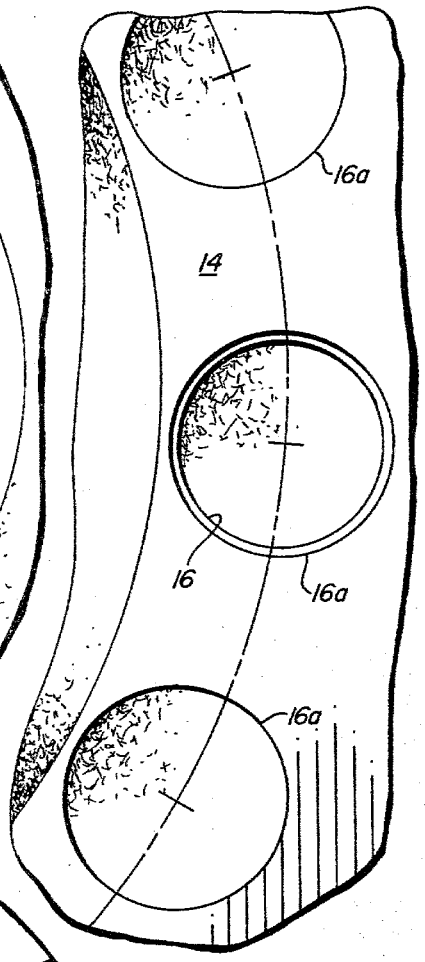
Figure 7C:
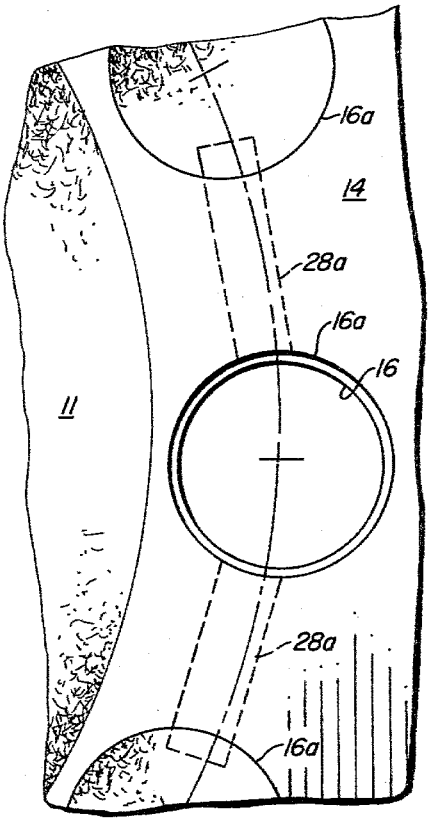

The next step in the method, as shown in FIGS. 7A and 7B, is drilling alternate column holes 16. Half of the apertures 16*a* thus have column holes 16 drilled. The remaining apertures 16*a* have not had column holes 16 drilled. At the completion of the drilling of the column holes 16, lateral holes 28*a*, as shown in FIG. 7C, are drilled at spaced intervals along the walls of the column holes 16. the lateral holes 28*a* are drilled which are long enough to intersect the location where the adjacent column holes 16 will be drilled.

Figure 7D:
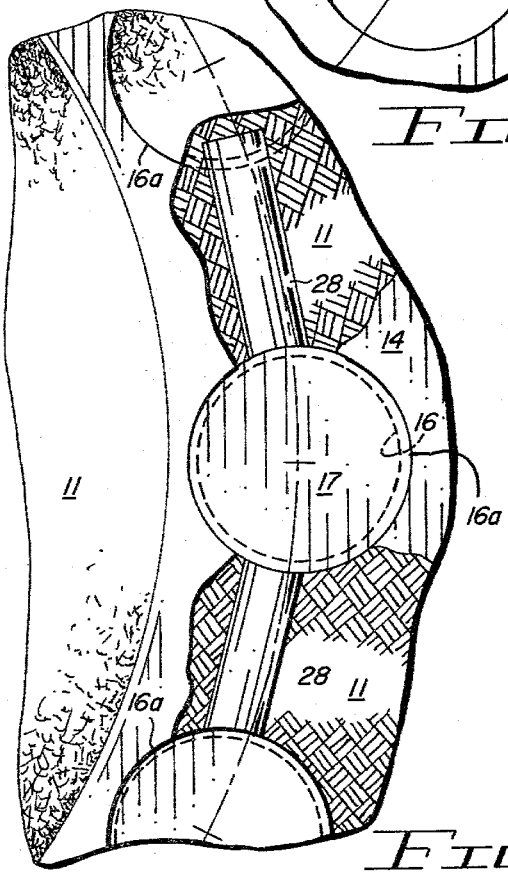

After the lateral holes 28*a* are drilled, the column holes 16, companion apertures 16*a*, and the lateral holes 28*a*, as FIG. 7D illustrates, are filled with concrete to form columns 17 and lateral supports 28.

Figure 8:
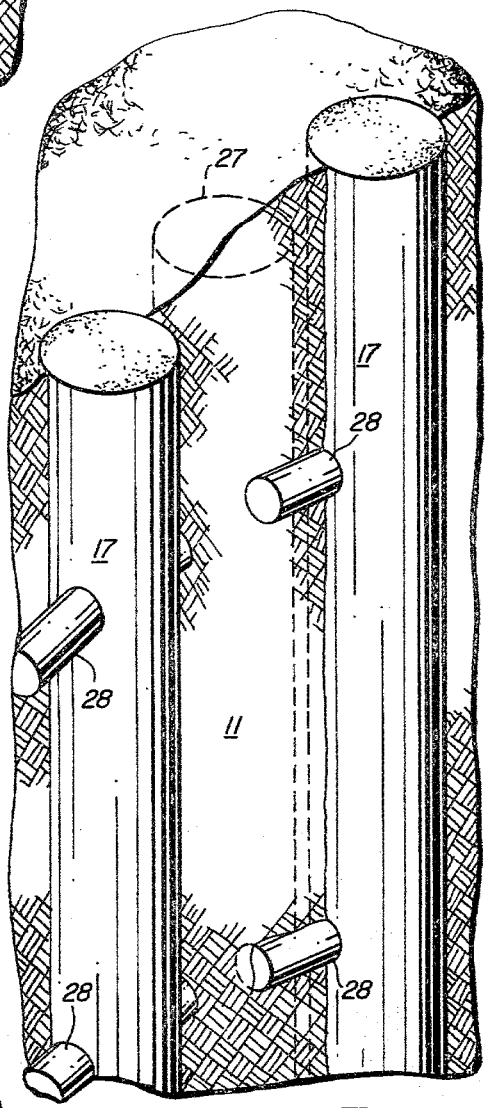
FIG. 8 is a perspective, partially cut-away view illustrating steps of forming a hole in the earth with columns and lateral supports in accordance with an alternate preferred embodiment of the invention.

FIG. 8 illustrates columns 17, lateral supports 28 and, as shown by the dashed lines 27, an adjacent column hole 16 remaining to be drilled.

Once one-half of the columns 17 and all of the lateral supports 28 have been formed, the remaining column holes 16 are drilled and filled with concrete. The area within the perimeter formed by the columns 17 is then excavated to form a hole in the earth.

Figure 9:
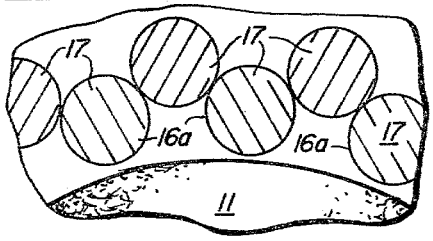
FIG. 9 is a top view illustrating an optional arrangement of columns for forming a hole in the earth in accordance with the first and alternate preferred embodiments.

FIG. 9 illustrates an optional arrangement of columns 17 which may be incorporated into either the first or alternate preferred embodiments of the improved method of the invention. The optional arrangement of columns 17 is especially useful in preventing loose soils from collapsing into the hole being formed in the earth.

Having described my invention in such a clear and concise manner as to enable those skilled in the art to understand and practice it, and having described the presently preferred embodiments thereof, I claim:

1. An improved method of forming a hole in the earth, for preventing the side walls of the hole from collapsing inwardly during and after excavation of the hole and specially adapted for use in loose soils, said method comprising:

(a) drilling individual column holes in an essentially circular arrangement, (b) filling said holes with concrete to the desired level so that columns are formed, (c) supporting said columns with structural members defining a plurality of discrete planes positioned along the length of said columns, said structural members in each of said planes being generally concentric with the circle formed by said columns and in reaction to said inward compressive forces, being compressed between at least two columns, and (d) excavating earth from within the perimeter of said columns.

2. An improved method of forming a hole in the earth, for preventing the side walls of the hole from collapsing inwardly during and after excavation of the hole and specially adapted for use in loose soils, said method comprising:

(a) drilling individual column holes in an essentially circular arrangement, (b) filling said holes with concrete to the desired level so that columns are formed, (c) excavating earth from the area within the perimeter formed by said columns to a point just below the level where a compression ring is to be attached to the interior surface of each of said columns, said interior surface facing the center of the circle generally formed by said columns, (d) installing said compression ring; and (e) repeating said steps of excavating earth to a point just beneath the installation level of said compression ring and of installing said compression ring, to install a plurality of spaced compression rings along said interior surfaces of said columns.

3. An improved method of forming a hole in the earth, for use in preventing the side walls of the hole from collapsing inwardly during and after excavation of the hole and specially adapted for use in loose soils, said method comprising:

(a) determining where a plurality of individual column holes in an essentially circular arrangement will be drilled, said column holes being identifiable as and divided into a first group and a second group, such that each of said column holes in said first group is adjacent to at least one of said column holes in said second group, (b) drilling said column holes in said first group, (c) drilling a plurality of lateral holes along the length of and extending from the walls of said column holes in said first group and intersecting the location where said column holes in said second group will be drilled, (d) filling said column holes of said first group and said lateral holes with concrete to the desired level so that columns and lateral supports are formed, (e) drilling said column holes in said second group, (f) filling said column holes of said second group with concrete to the desired level so that columns are formed, and (g) excavating earth from the area within the perimeter formed by said columns.

* * * * *